US009486026B1

(12) United States Patent
Cook, Sr.

(10) Patent No.: US 9,486,026 B1
(45) Date of Patent: Nov. 8, 2016

(54) PERSONAL AIR COOLING VISOR CLIP-ON

(71) Applicant: Don Whitney Cook, Sr., Ballwin, MO (US)

(72) Inventor: Don Whitney Cook, Sr., Ballwin, MO (US)

( * ) Notice: Subject to any disclaimer, the term of this patent is extended or adjusted under 35 U.S.C. 154(b) by 204 days.

(21) Appl. No.: 14/063,817

(22) Filed: Oct. 25, 2013

(51) Int. Cl.
*F04D 25/08* (2006.01)
*A42B 1/24* (2006.01)
*A42B 1/00* (2006.01)

(52) U.S. Cl.
CPC ..... *A42B 1/24* (2013.01); *A42B 1/008* (2013.01); *F04D 25/084* (2013.01)

(58) Field of Classification Search
CPC ..... A42B 1/008; A42B 1/24; A42C 5/04; F04D 25/08; F04D 25/084; F04D 29/646; F04D 29/60; F04D 29/601; F04D 29/626; F04D 25/0673
USPC ..... 417/234; 416/63, 146 R; 415/213.1
See application file for complete search history.

(56) References Cited

U.S. PATENT DOCUMENTS

| | | | | | |
|---|---|---|---|---|---|
| 4,893,356 | A * | 1/1990 | Waters | A42B 1/008 | 2/171.3 |
| 5,425,620 | A * | 6/1995 | Stroud | A42B 1/008 | 2/171.3 |
| 5,561,862 | A * | 10/1996 | Flores, Sr. | A42B 3/286 | 2/171.3 |
| 5,878,742 | A * | 3/1999 | Figueredo | A62B 18/003 | 128/201.24 |
| 2002/0085926 | A1 * | 7/2002 | Colburn | F04D 25/08 | 417/234 |

* cited by examiner

*Primary Examiner* — Charles Freay
*Assistant Examiner* — Philip Stimpert

(57) ABSTRACT

A device for attaching personal air cooling visor clip-on with a cooling 40×40×10 mm-5 volt battery pack/computer powered fan to cap or other head gear. The rigid rectangle plastic clip-on strap has holding cap clams, cable holding posts, 40×40×10 mm-5 volt fan, fan cable, fan cover, cable holding channel, usb wire and cable, fan cover tabs and fan tabs slots on the clip-on strap. The 40×40×10 mm-5 volt battery pack/computer powered fan is partially embedded into the plastic clip-on strap and secured by a fan cover using tabs with the connected fan and usb cables locking into and secured by channel holding posts in a channel. The strap is pushed onto a cap or headgear with the clams holding on top of the left and right top ends of the cap brim.

17 Claims, 6 Drawing Sheets

PERSONAL AIR COOLING VISOR CLIP-ON

FIELD OF THE INVENTION

This invention attaches a rectangle plastic personal air cooling visor clip-on which has an embedded 40×40×10 mm-5 volt battery pack/computer powered fan midway the length of clip-on strap to a cap or other headgear with easy means for attaching or removing as needed by the wearer. The fan creates a continuous flow of air to the head and forehead of the wearer. The personal air cooling visor clip-on provides comfort, convenience and control of extended cooling to the face and forehead. The personal air cooling visor clip-on can be powered through convenience and inexpensive power sources using the universal usb connection that connects the fan to a usb 5-volt battery pack/computer power pack or to a computer through the usb port.

DESCRIPTION OF THE PRIOR ART

There are numerous technology powered headgear for the cooling of the head and face. Typical of these patents is U.S. Pat. No. 6,032,291 to Asenguah in March 2000.

U.S. Pat. No. 4,680,815 July 1987 Hirsh etal

U.S. Pat. No. 4,893,356 January 1990 Waters

U.S. Pat. No. 5,085,231 February 1992 Johnson

U.S. Pat. No. 5,425,620 June 1995 Shroud

U.S. Pat. No. 4,799,858 January 1989 Shin-Chin

U.S. Pat. No. 6,257,235 July 2001 Kimberly-Clark World-wide

U.S. Pat. No. 6,843,964 January 2005 Yeh Kuo-Chung

D6858545 May 2012 Cobb

BACKGROUND OF THE INVENTION

Objectives and Advantages

Persons involved in outdoor activities are frequently inconvenienced by the heat or non-moving air while participating or just being outside. The user has the convenience of receiving cool air whenever needed. The personal air cooling visor clip-on is powered through a usb cable receiving power from any usb power source, 5-volt battery pack/computer pack or computer. The clip-on attachment can be removed if desired when not needed. The clip-on strap rectangle plastic clip-on strap with an embedded 40×40×10 mm-5 volt battery pack/computer powered fan midway the length of clip-on strap has an appearance that is considered to be fashionable and can be left attached if desired.

The personal air cooling visor clip-on provides comfort, convenience and control of extended cooling to the face and forehead. The air cooling clip-on fan can be powered through convenience and inexpensive power sources using the universal usb connection that connects the fan to a usb 5-volt battery pack/computer power pack or to a computer through the usb port.

SUMMARY OF THE INVENTION

This invention is a device for attaching a rectangle plastic clip-on strap with an embedded 40×40×10 mm-5 volt battery pack/computer powered fan midway the length of clip-on strap on a cap having a brim projecting on a front side thereof over the wearer's face comprises: (a) a rectangle plastic clip-on strap with an embedded 40×40×10 mm-5 volt battery pack/computer powered fan midway the length of clip-on strap having on the top view side left and right side cap clams in a lengthwise direction thereof; (b) attaching means having left and right side cap clams for anchoring to the brim of the cap at positions substantially corresponding to the positions of the left and right side portions of the under-side of the cap when placed in an operative position with respect to said brim; (c) attachment means the left and right side cap clams attaching to the left and right side portions of the under brim of the operative position on the brim of the cap.

In the preferred embodiment, the attachment means left and right cap clams elements mounted on the top view left and right side of clip-on strap and attaching meaning under the cap brim so that embedded 40×40×10 mm-5 volt battery pack/computer powered fan midway the length of clip-on strap can be attached in an upward position out of the way of the wearer. The clip-on strap abuts against a stationary surface of the cap brim so as to provide detent positions for maintaining the clip-on strap stably in position when attached. The attachment means are provided with the cap clams for attaching to the brim of the cap. The pre-assembly is convenient for attachment by wearers to their own caps.

Other objects, features and advantages of the present invention are described in detail below in conjunction with the drawings, as follows:

DETAILED DESCRIPTION OF THE INVENTION

Figure 1:
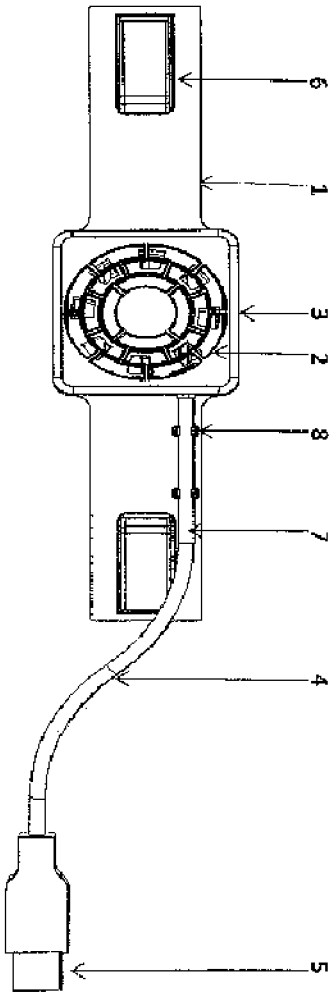
FIG. 1 is the bottom view of the rectangle plastic clip-on strap with an embedded 40×40×10 mm-5 volt battery pack/computer powered fan midway the length of clip-on strap.

FIG. 1 is a first embodiment of the device for attaching a rectangle plastic clip-on strap with an embedded 40×40×10 mm-5 volt battery pack/computer powered fan midway the length of clip-on strap to a cap. The preferred cap is of the type commonly referred to as a "baseball cap" having a cloth head portion 1 and a stiff brim 2 that extends frontward over the wearer's face. Baseball caps have a standard configuration and brim shape which allows the device to be dimensioned for attachment to and proper positioning on the brim. However, the principles disclosed herein can be readily adapted to other types of caps and hats, the only common requirement being that they have a stiff brim extending frontward over the wearer's face.

The device includes a rectangle plastic clip-on strap with an embedded 40×40×10 mm-5 volt battery pack/computer powered fan 3 midway the length of clip-on strap 5 fixed to an under brim 4 with left and right side portions. It extends in a widthwise direction across the width of the rectangle plastic clip-on strap with an embedded 40×40×10 mm-5 volt battery pack/computer. The powered fan is midway the length of clip-on strap, and clip-on strap clams 6*a*, 6*b* which are affixed on respective sides of the brim.

The rectangle plastic clip-on strap with an embedded 40×40×10 mm-5 volt battery pack/computer powered fan midway the length of clip-on strap is typically a plastic strip molded and thermally formed with suitable flexibility and is secured to brim 4. The clip-on strap clams 6*a*, 6*b*, cable holding posts are molded on clip-on strap 3 holding the cable, and form an assembly together which holds the rectangle plastic clip-on strap with an embedded 40×40×10 mm-5 volt battery pack/computer powered fan midway the length of clip-on strap in the operative position on the brim of the cap.

In this first embodiment, the anchor cap clams 6*a*, 6*b* consist of left and right side clams having spring legs which are press fitted onto the outer edge of the brim on its opposite sides. The cable holding posts are integrally formed as are the cap clams 6*a*, 6*b*. For example, all parts are molded as an integral plastic piece. The cap clams have stiff flexible sections with an opening at the downward side for snap fitting onto the brim so that the clip-on strap is held by the cap clams. The visor clip-ons are easily attached or removed from the cap.

The above-described device is easily fitted to a cap by press fitting the clip clams on the brim and pushing the rectangle plastic clip-on strap with an embedded 40×40×10 mm-5 volt battery pack/computer powered fan midway the length of clip-on strap onto the cap or other brimmed headgear. The assembly is also detachable in the reverse manner. The assembly can be combined for sale onsite at sporting events and convenient installation by wearers on their own caps. Alternatively, the device can be pre-assembled as a fixture on the cap.

Figure 2:
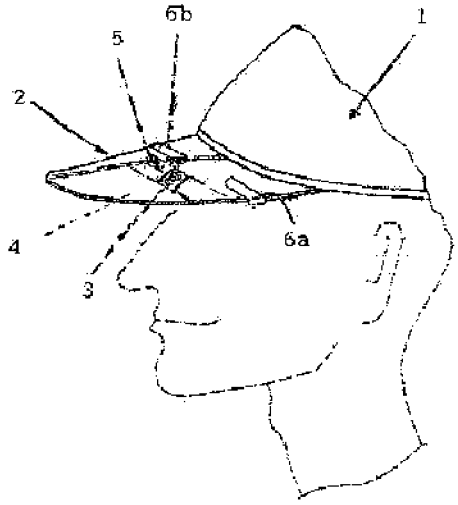
FIG. 2 is the top view of the rectangle plastic clip-on strap with an embedded 40×40×10 mm-5 volt battery pack/computer powered fan midway the length of clip-on strap fan cover that is not attached to the cap.

Thus, the rectangle plastic clip-on strap with an embedded 40×40×10 mm-5 volt battery pack/computer powered fan midway the length of clip-on strap will not be readily dislodged out of position unless positively pulled forward by the wearer. FIG. 2 is a second embodiment, bottom view of the device having rectangle plastic clip-on strap 1 with an embedded 40×40×10 mm-5 volt battery pack/computer powered fan 2 fixed (shown fitted in a groove) to the clip-on strap under brim notably held by the cover 3. The cable holding posts 8 are integrally formed. The clip-on strap clams 6 which are affixed on respective sides of the brim.

The 40×40×10 mm-5 volt battery pack/computer powered fan 2 is connected to a usb cable 4 with a usb connection 5 on the end which connects to a 5 v power source commonly used such as a computer or battery pack. The usb cable runs inside the cable holding channel 7 on the bottom view side of the rectangle plastic clip-on strap.

Figure 3:
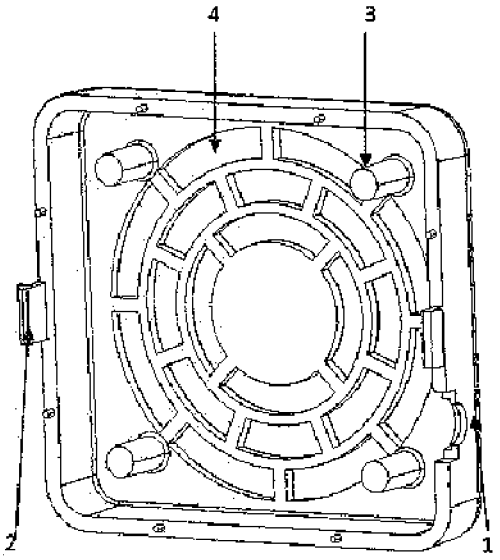
FIG. 3 is the top view of the fan cover of the rectangle plastic clip-on strap with an embedded 40×40×10 mm-5 volt battery pack/computer powered fan midway the length of clip-on strap.

FIG. 3 is the bottom view of the fan cover 1 which connects to the clip-on strap via the tabs 2. The cover has four pegs 3 that fit into the holes of the fan. The cover has grid openings 4 that let the air flow from the fan. The cover has a usb cable opening to allow the fan cable to connect to the 5 v power source commonly a computer or 5 volt battery pack.

Figure 4:
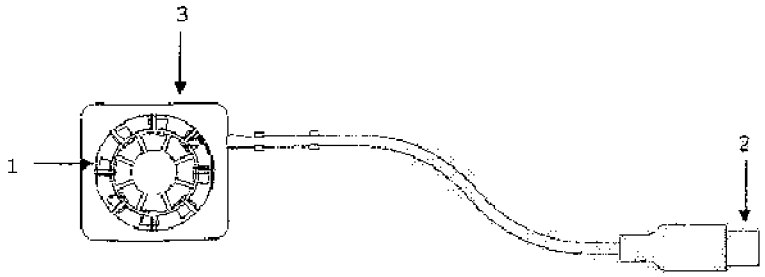
FIG. 4 is the bottom view of the fan cover of the rectangle plastic clip-on strap with an embedded 40×40×10 mm-5 volt battery pack/computer powered fan midway the length of clip-on strap with click-in post that fit into the rectangle plastic clip-on strap.

FIG. 4 is the top view of the embedded 40×40×10 mm-5 volt battery pack/computer powered fan 1. Fan 1 is connected to a usb cable 2 inside the fan cover 3. The usb connects to a 5 v power source commonly used such as a computer or 5 volt battery pack.

Figure 5:
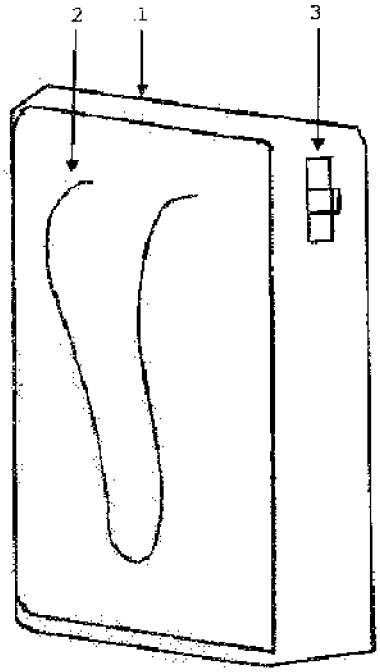
FIG. 5 is a back view of the usb 5 v power battery pack.

FIG. 5 is a back view of the usb 5 v power battery pack 1. The battery pack holds three AA batteries. The battery pack 1 has a clip 2 to secure the battery pack to clothing or other apparatus. The on/off 3 switch controls the flow and adds convenience of turning the fan on or off as desired.

Figure 6:
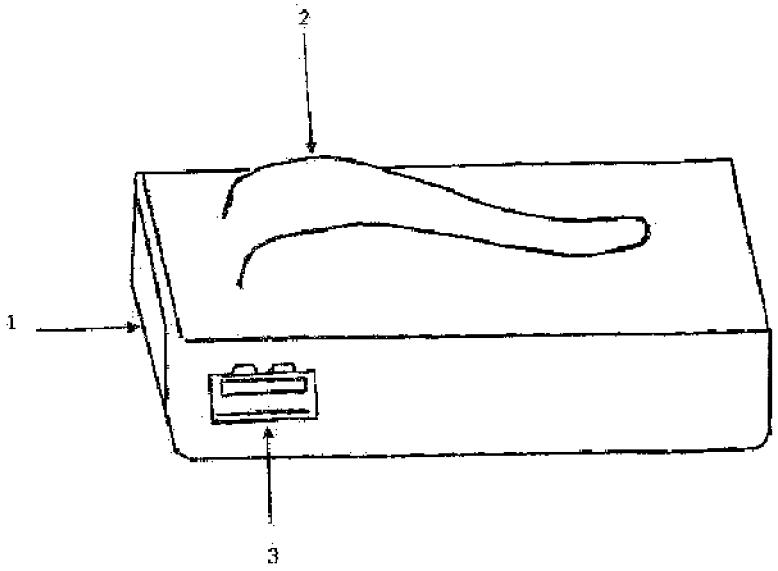
FIG. 6 is a side view of the usb 5 v power battery pack.

FIG. 6 is a side view of the usb 5 v power battery pack 1. The battery pack holds three AA batteries. The battery pack 1 has a clip 2 to secure the battery pack to clothing or other apparatus. The battery pack usb access port 3 adds the convenience of powering the fan from the 5 volt battery pack.

The rectangle plastic clip-on strap with an embedded 40×40×10 mm-5 volt battery pack/computer powered fan midway the length of clip-on strap is removable from caps so that both articles can be stored, used, and carried together. For portability, the rectangle plastic clip-on strap with an embedded 40×40×10 mm-5 volt battery pack/computer powered fan midway the length of clip-on strap can be moved from one cap to another. Since the rectangle plastic clip-on strap with an embedded 40×40×10 mm-5 volt battery pack/computer powered fan midway the length of clip-on strap are spaced from the wearer's face in the operative position the wearer can also wear glasses without discomfort.

The invention claim is:

1. A fan assembly for attachment to a brim of a hat, comprising:

a strap having at least one clamp configured to engage the brim of the hat, an electrical power source, a fan cover attached to a center of the strap along a length axis of the strap, and a fan disposed in the fan cover configured to receive power from the electrical power source and further configured to create a continuous flow of air; wherein, while the hat is being worn by a user, the strap and the fan cover are positioned beneath the brim and a width axis of the strap extends in a direction that is perpendicular to the length axis and parallel to a forward direction of extension of the brim.

2. The fan assembly according to claim 1, wherein the at least one clamp is configured to engage the brim of the hat.

3. The fan assembly according to claim 1, wherein the strap is configured to position the fan cover beneath the brim by engagement of the at least one clamp with the brim.

4. The fan assembly according to claim 1, wherein the electrical power source comprises a battery pack.

5. The fan assembly according to claim 4, wherein the battery pack is a 5V battery pack.

6. The fan assembly according to claim 4, wherein the battery pack is configured to hold three AA batteries.

7. The fan assembly according to claim 4, wherein the assembly further comprises a cable configured to electrically connect the fan to the electrical power source.

8. The fan assembly according to claim 4, wherein the battery pack comprises a clip configured to secure the battery pack to clothing.

9. The fan assembly according to claim 1, wherein the strap is formed of plastic.

10. The fan assembly according to claim 9, wherein the strap and the at least one clamp are molded as an integral plastic piece.

11. The fan assembly according to claim 1, wherein the at least one clamp comprises a spring leg configured to be press fitted onto the brim of the hat.

12. The fan assembly according to claim 1, wherein the electrical power source comprises an on/off switch configured to activate and deactivate the fan.

13. The fan assembly according to claim 1, wherein the fan cover comprises grid openings through which the flow of air passes.

14. The fan assembly according to claim 1, wherein the fan assembly is configured to direct the continuous flow of air to the head and forehead of a user wearing the hat.

15. The fan assembly according to claim 1, wherein the hat is a first hat, and the fan assembly is configured to be moved from the first hat to a second hat.

16. A hat and fan assembly, comprising:

a hat including:

a cloth head portion and a brim portion;

wherein a fan assembly according to claim 1 is attached to the brim portion.

17. The hat and fan assembly according to claim 16, wherein the at least one clamp comprises a left clamp and a right clamp, wherein the brim is disposed at a front portion of the head portion, and the left clamp and right clamp are configured to engage a left side and a right side of the brim respectively.

* * * * *